US006149027A

United States Patent [19]

Rathjen

[11] Patent Number: 6,149,027

[45] Date of Patent: Nov. 21, 2000

[54] COMBINATION FOOD PLATE AND BEVERAGE-CONTAINER-HOLDER ARTICLE

[76] Inventor: Kris M. Rathjen, 7031 Elizabeth Dr., McLean, Va. 22101

[21] Appl. No.: 09/448,493

[22] Filed: Nov. 24, 1999

Related U.S. Application Data

[63] Continuation-in-part of application No. 09/113,283, Jul. 10, 1998, which is a continuation-in-part of application No. 08/833,501, Apr. 9, 1997, Pat. No. 5,853,104.

[51] Int. Cl.[7] ..... A47G 19/00

[52] U.S. Cl. ..... 220/574; 220/23.83; 220/23.86

[58] Field of Search ..... 220/574, 23.86, 220/23.83

[56] References Cited

U.S. PATENT DOCUMENTS

| | | |
|---|---|---|
| Re. 27,688 | 6/1973 | White et al. . |
| D. 150,666 | 9/1948 | Zachary . |
| D. 157,700 | 3/1950 | Price . |
| D. 310,820 | 9/1990 | Wasserman . |
| 2,117,102 | 5/1938 | Pittler . |
| 3,250,422 | 5/1966 | Parish . |
| 3,381,825 | 5/1968 | Bessett . |
| 3,498,470 | 3/1970 | Thomas . |
| 3,955,672 | 5/1976 | Brundage . |
| 4,043,478 | 8/1977 | Duncan . |
| 4,461,396 | 7/1984 | Harper . |
| 4,607,758 | 8/1986 | Stevens . |
| 4,938,373 | 7/1990 | McKee . |
| 4,966,297 | 10/1990 | Doty . |
| 5,060,820 | 10/1991 | Boerner . |
| 5,110,170 | 5/1992 | Boatwright . |
| 5,207,743 | 5/1993 | Costarella et al. . |
| 5,234,125 | 8/1993 | Roberts . |
| 5,249,700 | 10/1993 | Dumke . |
| 5,259,528 | 11/1993 | Pace et al. . |
| 5,335,787 | 8/1994 | Finchum et al. . |
| 5,397,089 | 3/1995 | Kataoka . |
| 5,419,455 | 5/1995 | Russeau . |
| 5,429,231 | 7/1995 | McSpadden . |
| 5,441,164 | 8/1995 | Beck et al. . |
| 5,598,944 | 2/1997 | Aragona . |
| 5,803,305 | 9/1998 | Perlis et al. ..... 220/574 |
| 5,853,104 | 12/1998 | Rathjen . |

*Primary Examiner*—Steven Pollard
*Attorney, Agent, or Firm*—Nixon & Vanderhye

[57] ABSTRACT

The combined food plate and beverage-container-holder article comprises a plate body having a member in the form of an upstanding truncated cone. The cone has an open upper end for receiving a beverage container. A support base is provided inside the member and includes a plurality of depending support elements terminating in horizontally directed flanges to support a beverage container.

20 Claims, 14 Drawing Sheets

Fig. 2
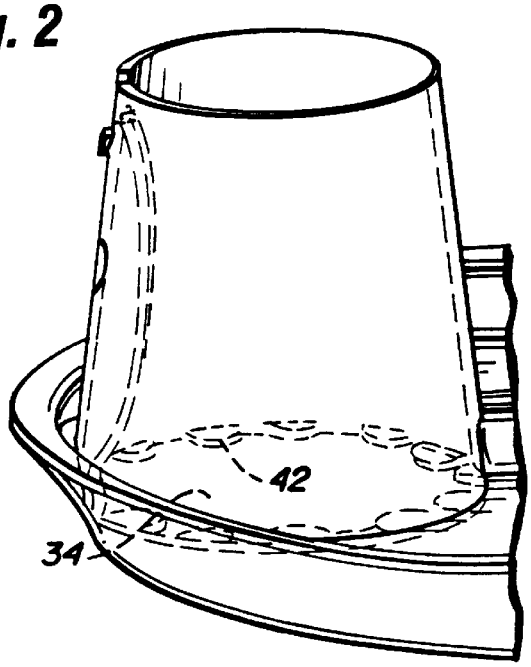
Fig. 4a
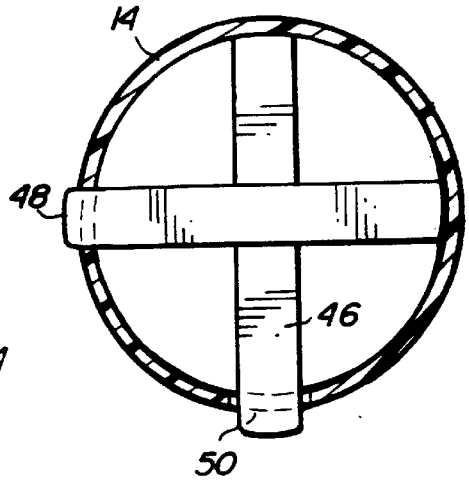
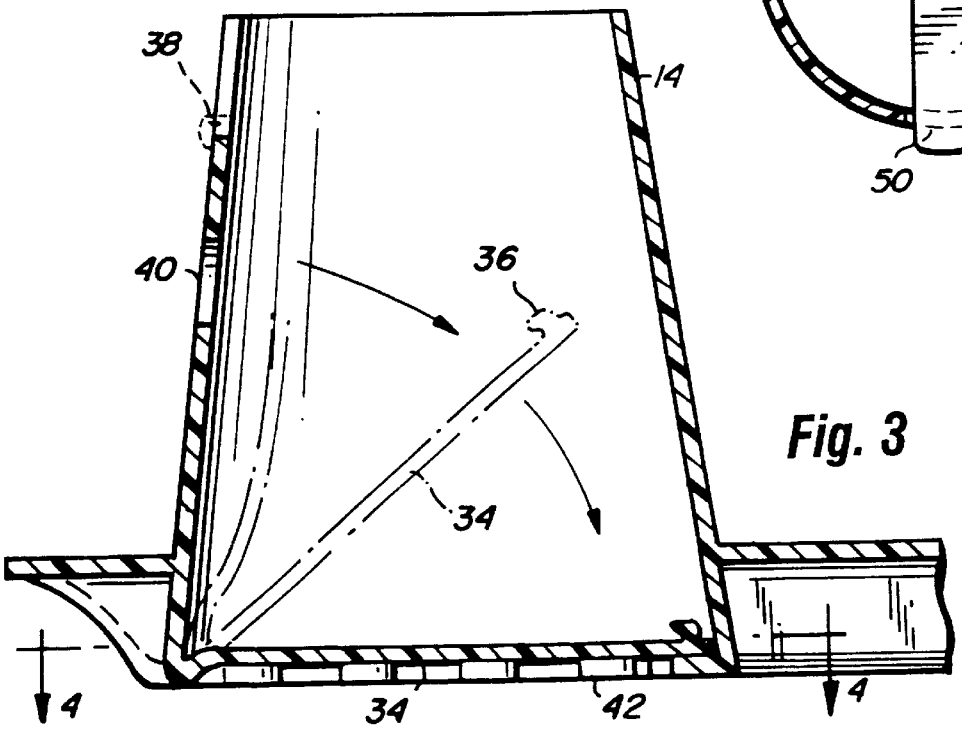
Fig. 3

Fig. 4
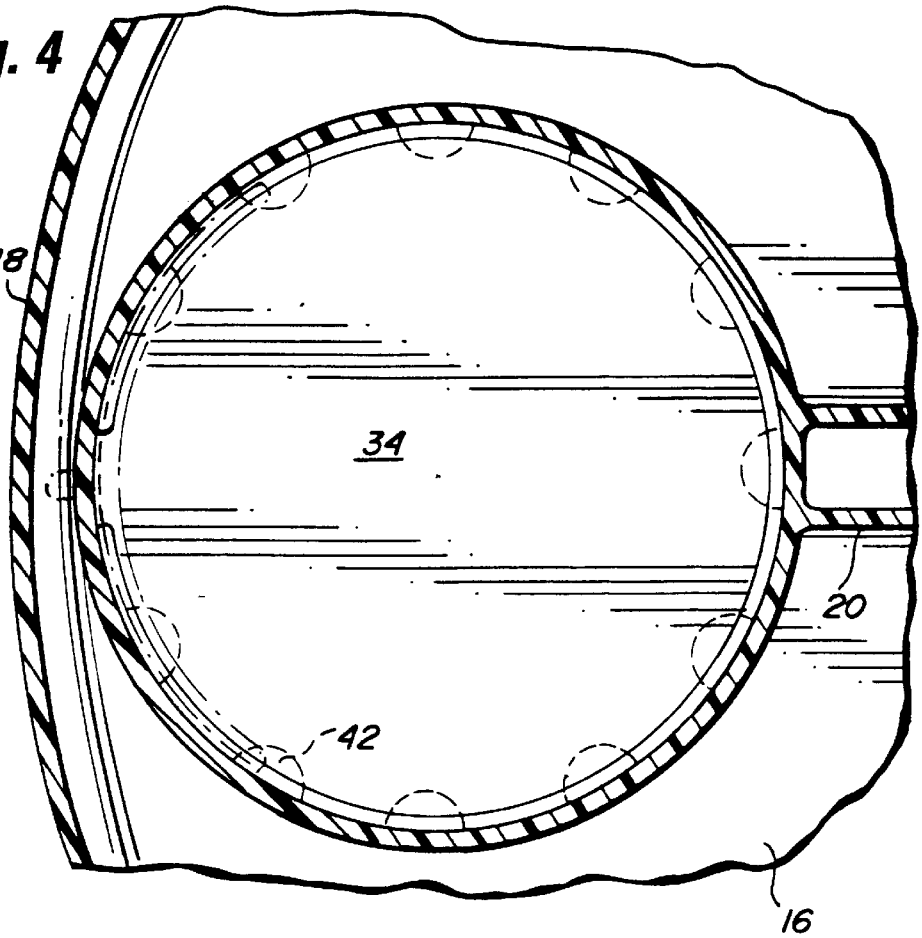
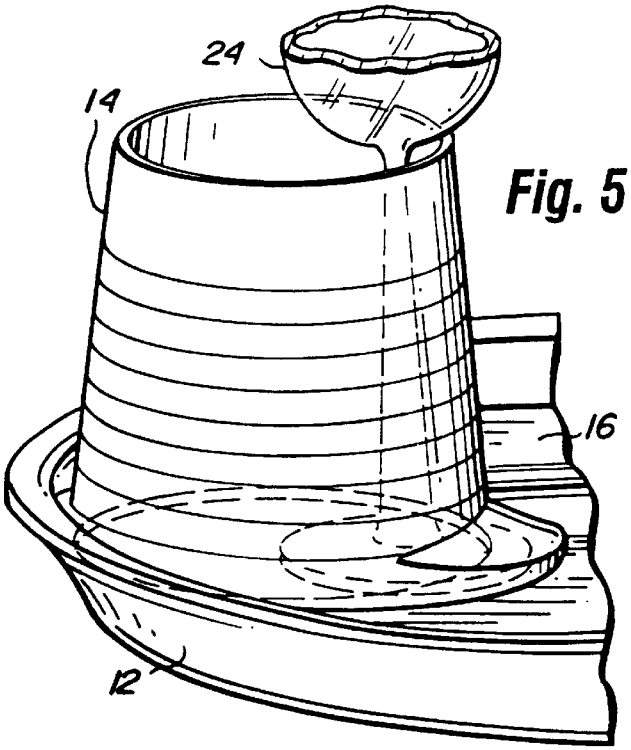
Fig. 5
Fig. 6
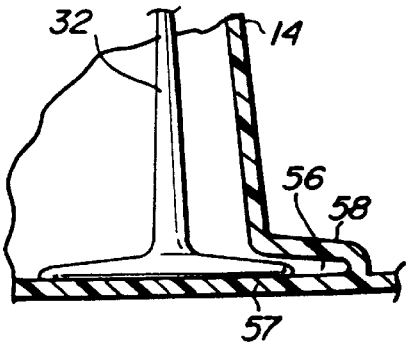

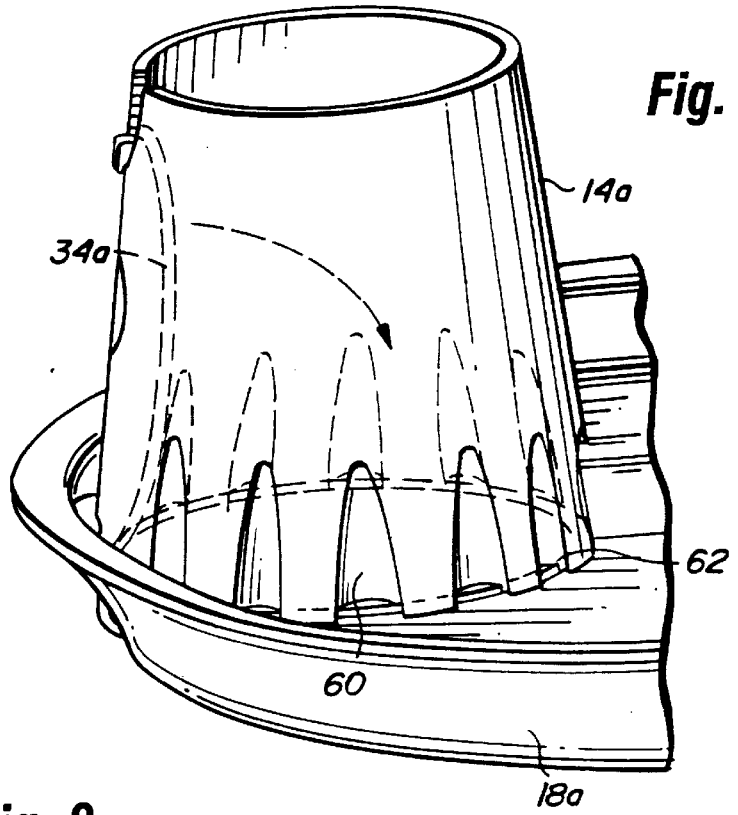
Fig. 7
Fig. 8
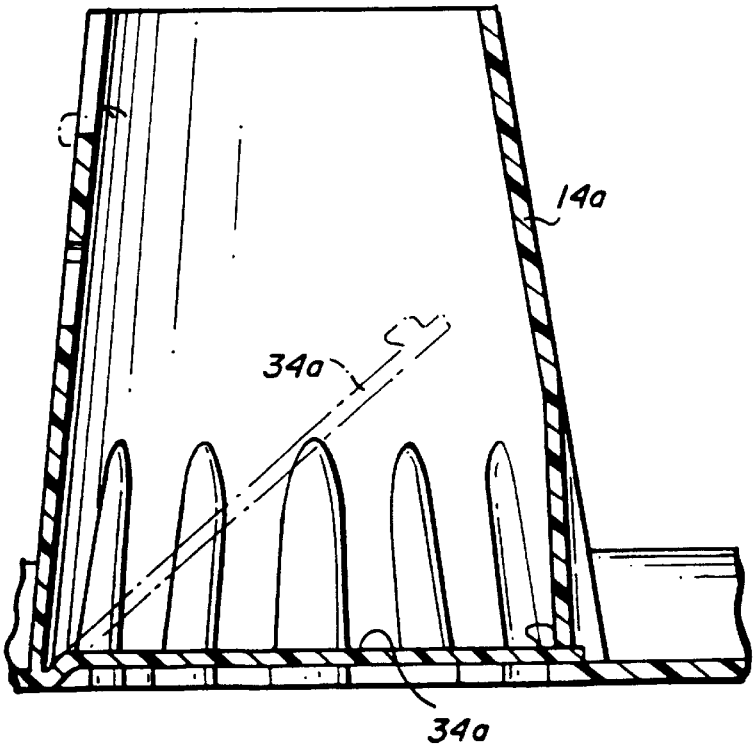
Fig. 9
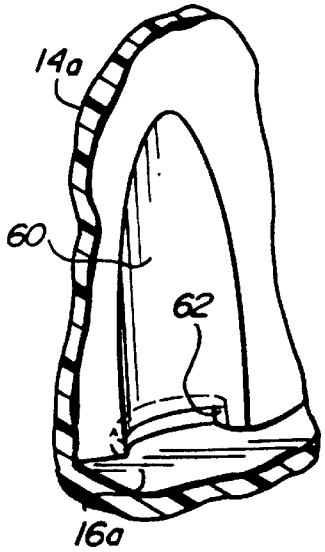

Fig. 15
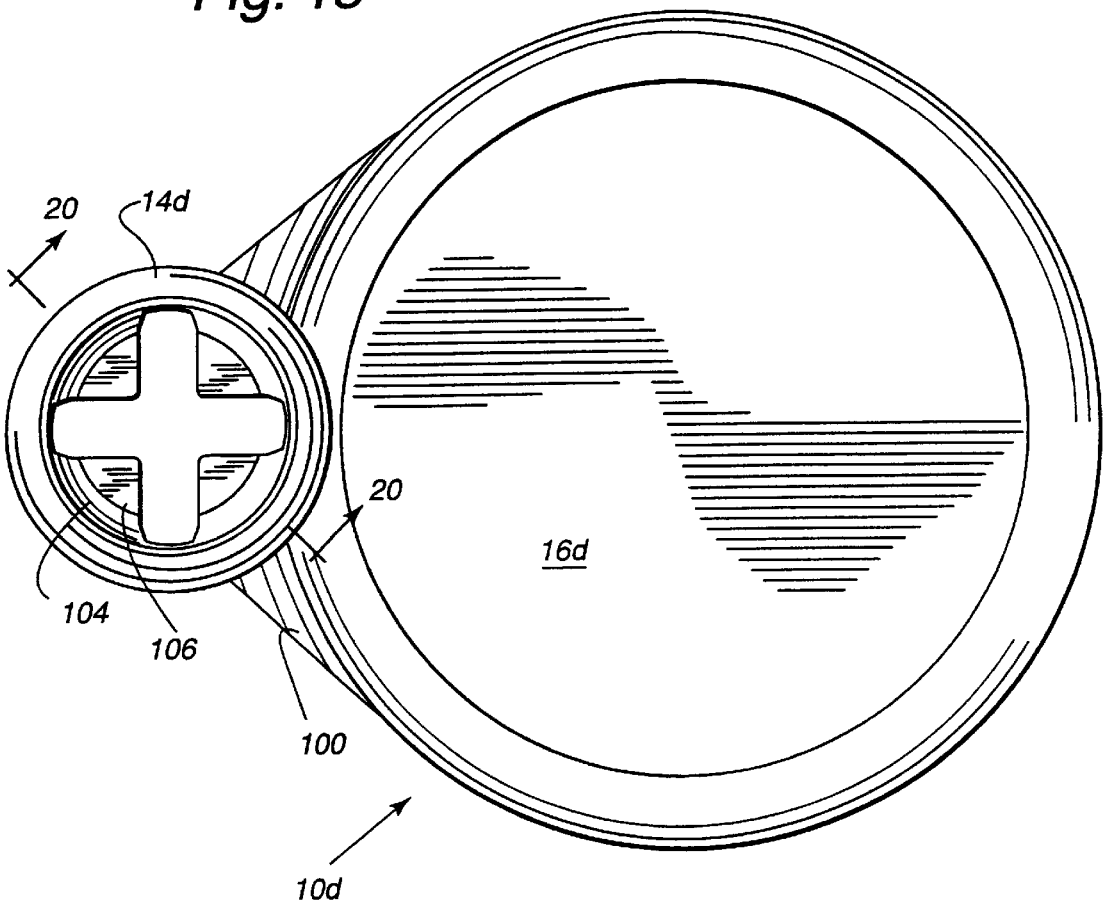
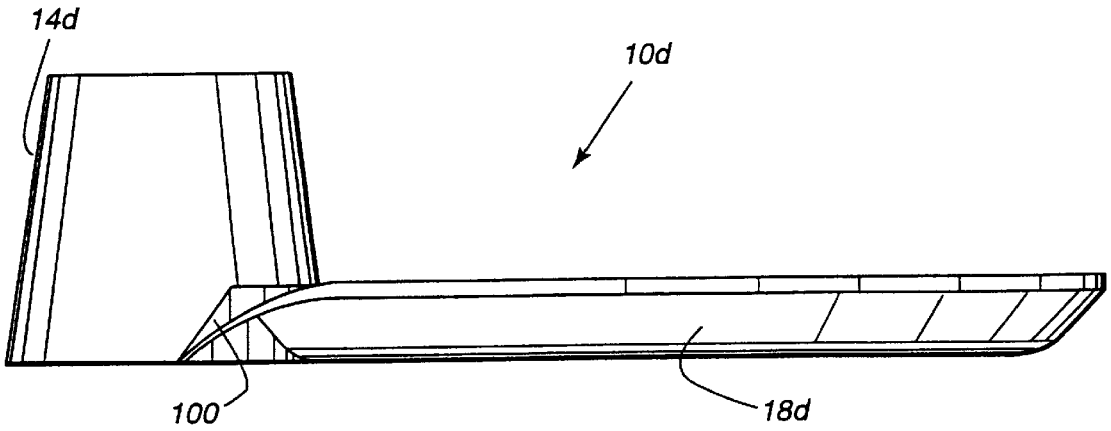
Fig. 16

Fig. 21
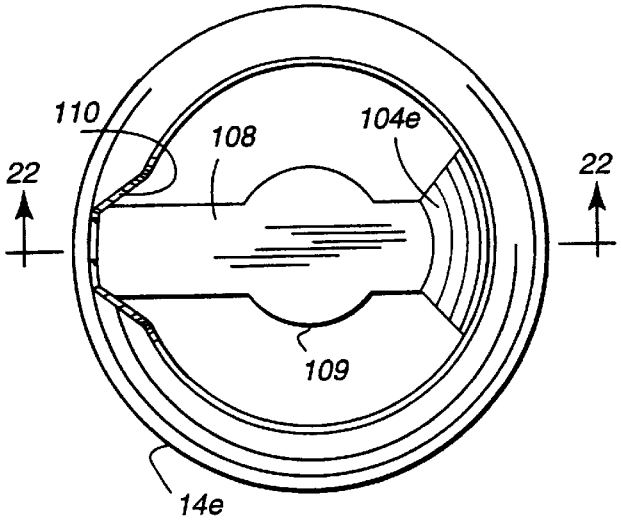
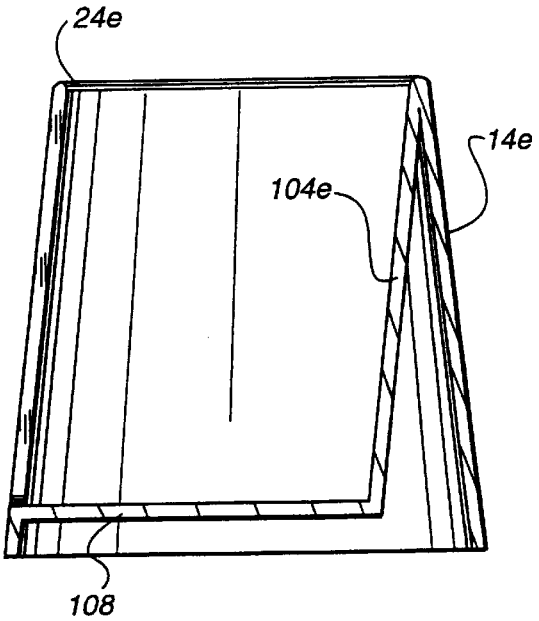
Fig. 22
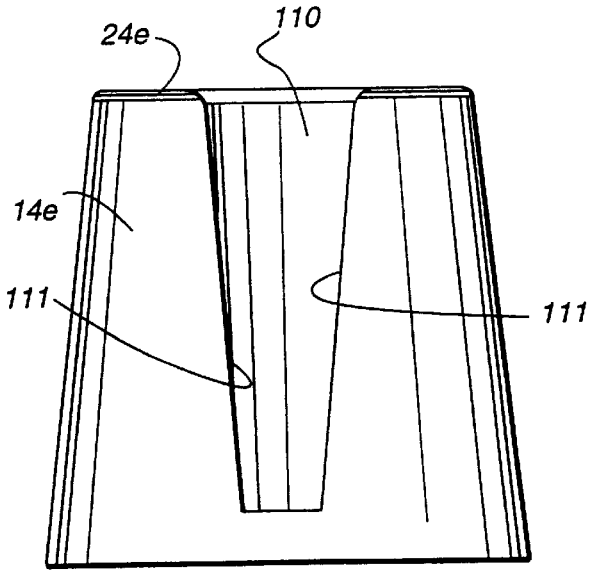
Fig. 23

COMBINATION FOOD PLATE AND BEVERAGE-CONTAINER-HOLDER ARTICLE

RELATED APPLICATIONS

This application is a continuation-in-part of application Ser. No. 09/113,283, filed Jul. 10, 1998, which in turn is a continuation-in-part of application Ser. No. 08/833,501, filed Apr. 9, 1997, now U.S. Pat. No. 5,853,104, the disclosures of which is incorporated herein by reference.

TECHNICAL FIELD

The present invention relates to a combined food plate and beverage-container-holder article for facilitating the carrying of food and a beverage in one hand and particularly relates to nestable or stackable combined food plate and beverage-container-holder articles to facilitate handling and storage thereof.

BACKGROUND

A substantial number of proposed designs have attempted to solve the problems associated with simultaneously carrying food on a plate and a beverage container in one hand. For example, at parties, gatherings, socials, receptions and the like, it is commonplace to pass along a buffet with a plate in one hand and a beverage container in another hand. In order for an individual to serve food onto his or her plate, the plate or beverage container must be set down to free a hand for use in the serving process. Alternatively, attempts can be made to grasp both the plate and the beverage container in one hand. Obviously, if the plate and the beverage container are separate, great difficulty is encountered in attempting to balance the beverage container typically on the plate while serving food onto the plate. Similar problems occur when an individual attempts using a utensil to eat from the plate or to drink from the beverage container. Current designs of combined food plate and beverage holders fall considerably short of solving these problems.

For example, certain designs still require the individual to grasp both the beverage container and the plate with one hand, typically requiring the user to surround the beverage container with the thumb and forefinger, while holding the tray with the other portions of the same hand. Substantial manipulation of the individual's hand and fingers are required to remove the beverage container from its position between the thumb and forefinger, while at the same time balancing or attempting to balance the food on the plate. These changes in gripping the plate and beverage container, while simultaneously avoiding spillage are difficult at best and oftentimes result in spilled food and/or beverage.

On certain occasions, another problem presents itself in that stem glasses are typically used. Stem glasses are even more difficult to handle and manipulate due to the nature of the glass itself, i.e., a bowl at the top, a flat base at the bottom and a very thin stem interconnecting the bowl and base. Combined food plate and beverage-container-holder articles specifically accommodating stem glasses are known but inadequate. Certain designs accommodate stem glasses by securing the base of the stem glass to the food plate. Oftentimes, horizontal removal of the stem glasses from the plate is required, again necessitating the use of two hands in order to separate the stem glass from the food plate. Also, stem glasses are sometimes simply placed in a defined receptacle or simply an open area within the food plate body. By grasping the plate body, this more often than not results in spilling the contents of a stem glass or causing it to tip over. Further, those known combined food plate and beverage-container-holder articles do not accommodate different types of beverage containers, e.g., cans, bottles, stem glasses, cups and the like, and certain of such articles are designed for use with a particular type of beverage container, for example, a stem glass only. The nestability or stackability of the combined food plate and beverage-container-holder articles is also a highly desirable characteristic which often is not found in such prior articles due to the unique nature of the construction necessary to accommodate both the food plate and beverage container.

DISCLOSURE OF THE INVENTION

In accordance with the present invention, there is provided a novel and improved combined food plate and beverage-container-holder article which minimizes or eliminates the foregoing and other problems associated with prior food plate and beverage-container-holders and affords various advantages in construction and use, as will now be explained. In the present combined food plate and beverage-container-holder article, there is provided a food plate body having a generally peripherally upstanding lip to confine the food on the plate. The plate body may have a number of upstanding ribs which divide the plate into separate compartments and afford strength to the plate. Off-center and toward one side of the plate body, there is provided a truncated cone upstanding from the plate body having a lower end of larger diameter than the diameter of its open upper end. The member is specifically sized such that the upper smaller diameter end may receive beverage containers, such as bottles or cans, while at the same time provide support for the bowl of stem glasses when the stem glasses, including their base and stem, are received through the upper opening. Further, the upper opening is sized to receive the lower inverted frustoconical shape of commercially available cups so that the flange typically found intermediate the upper and lower ends of the cups may rest on the margins of the truncated cone.

To enable the cans or bottles, once passed through the upper opening of the member, to be supported, the member in one embodiment hereof includes a support base which is movable between a first position substantially closing the bottom of the member and providing a support for a beverage container, e.g., a can or bottle placed within the member and a second open position such that the lower portion of a stem glass, for example, its base and stem, may pass entirely through the member with the glass being supported only from its bowl. More particularly, the support base is pivoted between a first position closing the opening in the lower part of the member to support the stem glass and a second position inclined within the member and bearing against an interior wall surface of the member. With the support base in the first position, the can or bottle received through the upper opening may come to rest on the support base in a plane parallel to the plane of the plate body. If a support for a stem glass is required, the support base may be left in its upward second position whereby the reduced diameter margin of the member about the upper opening engages and supports the bowl of the stem glass. In the event that the bowl of the stem glass is smaller in diameter than the diameter of the upper opening, the support base can be placed in the horizontal position to support that type of stem glass. Alternatively, a slot may be provided in the member adjacent its base such that a portion of the flat base of the stem glass may be received in the slot thereby supporting the stem glass.

It will be appreciated that an individual may grasp the article by solely gripping the frustoconical member or dividing his/her fingers between the frustoconical member and a location below the plate. Thus, the plate and member may be held with comfort and ease without tilting the plate and beverage container and notwithstanding an imbalance on the plate caused by the weight of the food.

The article of this invention is particularly useful by individuals who have physical disabilities with an upper extremity, i.e., difficulty with grasping objects, or individuals limited to one normally functioning upper extremity. Carrying food and drink with current designs can pose problems and affect an individual's self-reliance when he or she is unable to carry the beverage and food tray with one hand without great difficulty. The present design is also an improvement on current combined food and beverage holders specifically by enabling the article to be readily and easily placed or set down on a table or flat surface with only one hand and without any portion of that hand or arm underlying the plate which would otherwise cause difficulty in manipulating the plate and setting the plate down.

In a further embodiment of the present invention, the truncated conical member may have one or more support elements depending from adjacent the upper end of the member terminating at lower ends in a generally horizontally directed flange. The support element is spaced from the interior wall surface of the member and is preferably inclined inwardly from its upper end to its lower end forming a resilient support element. In this manner, beverage containers of different size can be easily supported within the member.

In a further preferred embodiment hereof, the member may have a slot opening through the upper end of the member and closed at its lower end. Preferably, the edges defining the slot taper toward one another in a downward direction toward the closed end of the slot. Consequently, a beverage container having a handle may be received within the member with the handle received in the slot.

Furthermore, and in another preferred embodiment, the article may comprise a plate or tray having a pair of truncated cone-shaped members for receiving two beverage containers. For example, trays are typically used to carry food and beverages for a number of individuals. Thus, a pair of members may be provided on a food-carrying tray to accommodate at least two beverage containers.

It is a feature of the present invention to provide a combination food plate and beverage-container-holder article which can be stacked or nested with similarly constructed articles. To accomplish that, the truncated conical members of the articles may be inserted one within the other with the base support in its second position in order to nest the plates in generally spaced parallel relation one with the other. This reduces transportation and storage space while enabling, through the pivoted support base, the beverage-holding aspect of each article to accommodate various types of beverage containers such as stem glasses, cans, bottles and the like.

In a preferred embodiment according to the present invention, there is provided a combination food plate and beverage-container-holder article comprising a plate body for supporting food and having a generally upstanding lip substantially about the margin of the body and a beverage-container-holder formed integrally with and upstanding relative to the body, the holder including a generally truncated cone-shaped member having an open upper end spaced above the plate body whereby a beverage container is at least in part receivable within the member through the open upper end thereof and a lower wall portion adjacent the plate body larger in diameter than a diameter of the open upper end, the member being located off-center relative to the plate body and adjacent a margin thereof, the member having at least one beverage container support element carried thereby within the member below the upper end thereof for supporting the beverage container within the holder.

In a further preferred embodiment according to the present invention, there is provided a combination food plate and beverage-container-holder article comprising a plate body for supporting food and having a generally upstanding lip substantially about the margin of the body, a beverage-container-holder formed integrally with and upstanding relative to the body, the holder including a generally truncated cone-shaped member having an open upper end spaced above the plate body for receiving at least in part a beverage container within the member through the open upper end thereof and a lower end of the member defining an opening larger in diameter than a diameter of the open upper end of the member, a support carried by the article depending from a first location within the member to a second location within the member lower than the first location, the support lying within peripheral confines of the member to at least partially close the lower open end of the member for supporting the beverage container in the beverage-container-holder, the member being located off-center relative to the plate body and adjacent a margin thereof, the member extending upwardly above the lip a distance sufficient such that at least a portion of the member extending upwardly above the lip can be grasped by an individual's fingers above the plate body to enable the plate with food thereon and a beverage container in the beverage-container-holder to be carried by one hand.

In a still further preferred embodiment according to the present invention, there is provided a nestable combination food plate and beverage-container-holder articles comprising a plurality of plate bodies for supporting food thereon, each plate body having a generally upstanding lip substantially about a margin of the body and a beverage-container-holder formed integrally with and upstanding from the body, each of the beverage-container-holders including a generally truncated cone-shaped member having an open upper end spaced above the plate body for receiving at least in part a beverage container within the member through the open upper end thereof and a lower wall portion adjacent the plate body defining an open lower end larger in diameter than a diameter of the open upper end of the member, each member being located off-center relative to the body and adjacent a margin thereof, a support element carried by each member depending from a first location within the member to a second location within the member lower than the first location and spaced from a wall of the member for supporting the beverage container in the beverage-container-holder and the plate bodies being nestable relative to one another with each underlying member being in part receivable within an overlying member of an adjacent article through the open lower end of the overlying member and in part located between the support element and the member wall of the overlying member, the support element of the overlying member lying at least in part within the peripheral confines of the underlying member.

Accordingly, it is a primary object of the present invention to provide a novel and improved combination food plate and beverage-container-holder article which facilitates the handling of a combined food plate and beverage container with one hand and which may accommodate various sizes and types of beverage containers, as well as enable stacking or nesting of the containers for storage and transportation purposes prior to use.

BRIEF DESCRIPTION OF THE DRAWINGS

FIG. 2 is a fragmentary view of the article with the base support illustrated in a second position leaving open the bottom of the member;

FIG. 3 is an enlarged fragmentary cross-sectional view thereof illustrating the movement of the base port between the second and first positions thereof;

FIG. 4 is an enlarged cross-sectional view taken generally about on line 4—4 in FIG. 3;

FIG. 4*a* is a reduced cross-sectional view illustrating a bottom closure for the article according to a further form of the present invention;

FIG. 5 is a view similar to FIG. 2 illustrating a still further embodiment of the present invention;

FIG. 6 is an enlarged fragmentary cross-sectional view illustrating the support for the base of a stem glass in the embodiment of FIG. 5;

FIG. 7 is a view similar to FIGS. 2 and 5 illustrating a still further form of the present invention;

FIG. 8 is a fragmentary cross-sectional view thereof;

FIG. 9 is an enlarged fragmentary cross-sectional view illustrating a detail of the embodiment of the invention illustrated in FIG. 7;

FIG. 15 is a top plan view thereof;

FIG. 16 is a side elevational view thereof;

FIG. 21 is a top plan view of a beverage-containing member portion of the article without the plate or tray illustrating a further embodiment of the present invention;

FIG. 22 is a cross-sectional view thereof taken generally about on line 22—22 of FIG. 21;

FIG. 23 is a side elevational view of the member of FIG. 22 without the article.

BEST MODE FOR CARRYING OUT THE INVENTION

Figure 1A:
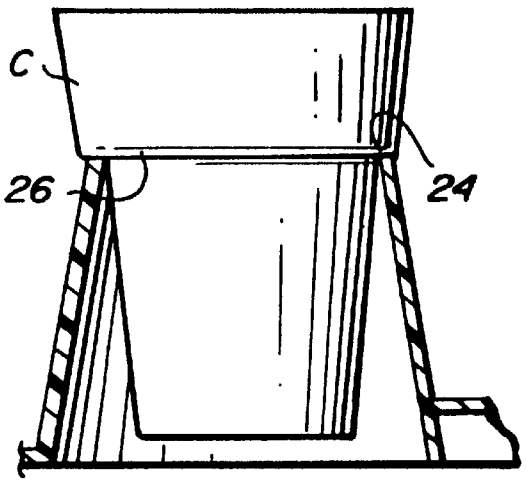
FIG. 1*a* is a fragmentary cross-sectional view of the beverage-container-holder portion of the article illustrating a cup being held by the article.
Figure 1:
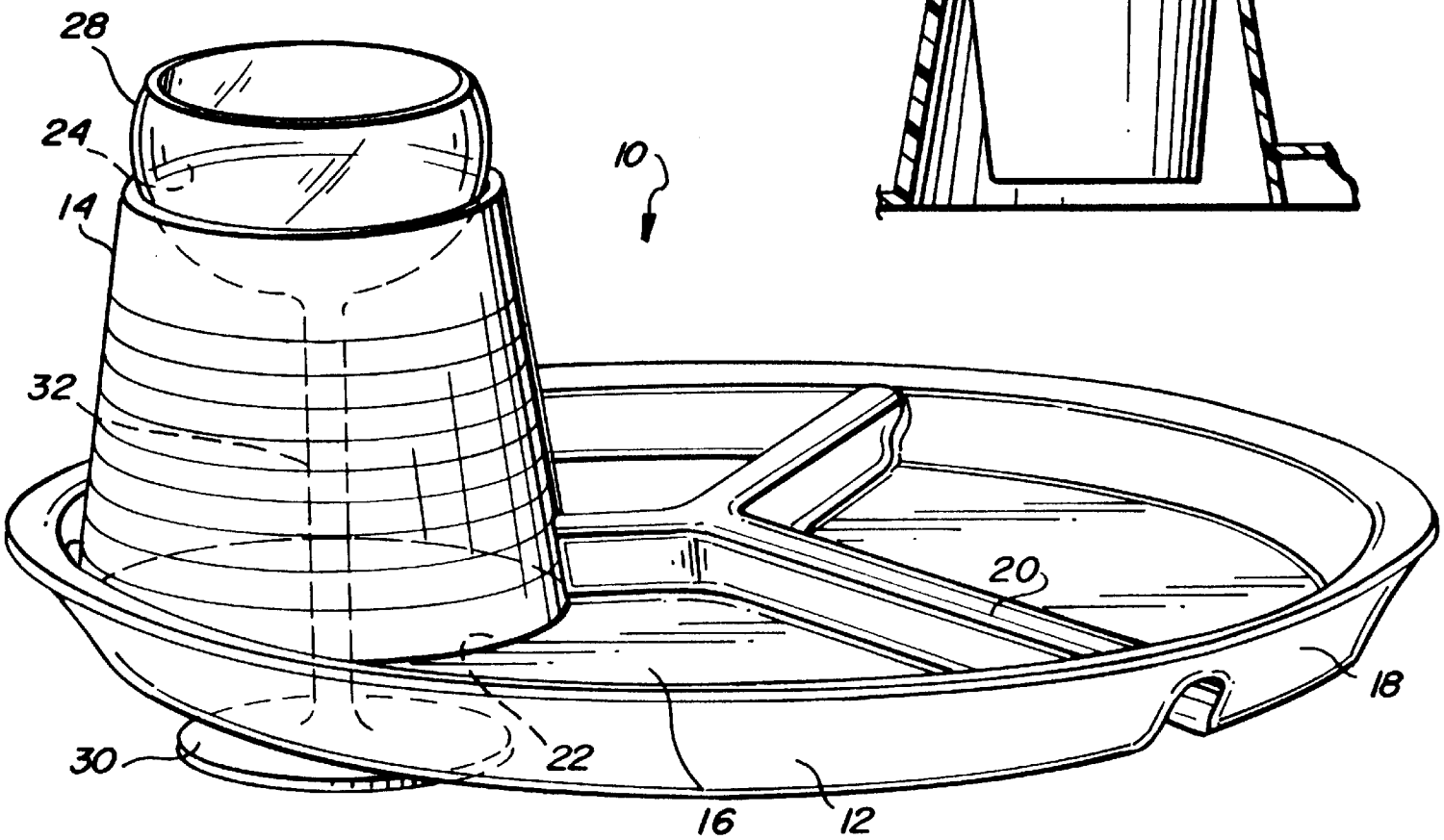
FIG. 1 is a perspective view of a combination food plate and beverage-container-holder article constructed in accordance with the present invention.

Referring now to the drawings, particularly to FIG. 1, there is illustrated a combination food plate and beverage-container-holder article, generally designated 10, and comprising a plate body 12 and a frustoconical beverage-container-holder member 14. As illustrated, the plate body 12 includes a generally flat or horizontal plate bottom 16 about which there is formed an upstanding lip 18. The portion of the lip 18 may share the same wall as part of the member 14. The plate body 12 includes a plurality of upstanding ribs 20 which divide the plate body into various compartments as illustrated and which ribs 20 also serve to reinforce the plate body 12.

Off-center from the center of the plate body 12 and lying to one side of the plate is a truncated conical beverage-container-holder member 14 having an opening 22 at its lower end larger in diameter than the diameter of the opening 24 at its upper end. It will be appreciated from a review of FIG. 1 that the member 14 extends a substantial distance above the plate body 12 and typically may comprise four or five times the height of the plate body, including lip 18. In this fundamental form of the present invention as illustrated in FIG. 1*a*, the upper reduced diameter opening 24 may provide a support for a cup C placed in the opening, the cup having an outwardly directed flange 26 for resting on the margin of the upper opening 24. As illustrated in FIG. 1, a different type of beverage container may likewise be supported in this form of the invention. Thus, a stem glass having a bowl 28, a flat base 30 and a stem 32 interconnecting the bowl 28 and base 30 may be supported likewise by the margin of the reduced diameter opening 24 at the top of member 14. The base 30 may thus extend below the plate body 12.

It will be appreciated that from a review of drawing FIG. 1, an individual may grasp the member 14 readily and easily, thus supporting both the beverage container within the member 14 and the plate body 12. The diameter of the member 14, while flaring outwardly in a downward direction, remains sufficiently small to enable an individual to grasp about the member 14 with the full five fingers of one hand and thus support the plate body 12, member 14 and any food and/or beverage products carried by the article simultaneously with one hand. It will be appreciated that the member 14 can be provided with finger grips, for example, flutes formed in horizontal bands about member 14, to facilitate the gripping of member 14 by the individual. It will also be appreciated that the member 14, while useful for supporting cups and stem glasses having large diameter bowls, e.g., bowls 28, the member 14 may have an upper opening larger in diameter than the diameter of a conventional beverage can or bottle. To accommodate the different sizes of beverage containers which may be held by the combined food plate and beverage-container-holder article of the present invention, a support base is provided in those instances where it is necessary to support a beverage container having a diameter less than the diameter of the upper opening through member 14.

In the illustrated and preferred form of the invention, a support base 34 is provided and is generally circular in configuration. Support base 34 is pivoted along one side to the base of the member 14 or to the plate body 12 as convenient and desired. As illustrated in FIGS. 2 and 3, the support base 34 is therefore pivoted between a first position lying generally horizontal and parallel to the plane of the plate bottom 16, i.e., a position extending within the interior or peripheral confines of member 14, and an upstanding, out-of-the-way position illustrated by the dot-dash lines of FIGS. 2 and 3 and bearing against the interior surface of the walls of member 14. A catch 36 on support base 34 and an opening 38 in the wall of member 14 enables the support to be maintained in its second inclined position. To pivot the support base 34 from the inclined position to the horizontal position, an opening 40 is provided in the wall of member 14 such that an individual may push and thereby pivot support base 34 into the horizontal position.

To provide support for the base 34 in the horizontal position, a plurality of tabs or inwardly directed flanges 42 are provided, preferably as continuations of the bottoms 16 of the plate body 12. Thus, tabs 42 as illustrated in FIG. 3 underlie the support base 34 when disposed in its first position illustrated in the full lines in FIG. 3. In an alternative form of the present invention, it will be appreciated that a pair of strips 46 may be pivoted to member 14 along orthogonally related sides of member 14 to form a cross-pattern at the base of member 14. The distal ends 48 of the strips 46 may be received in slots 50 formed in the lower wall of member 14 whereby the crossed strips 46 form a stop and a support for bottles or cans disposed in member 14.

Referring to FIG. 5, and in a further effort to accommodate variously sized beverage containers, there is illustrated a further form of the present invention wherein a stem glass having a bowl smaller in diameter than the diameter of the open upper end of member 14 may still be supported by the article hereof. To accomplish this, a slot 56 (FIG. 6) is formed through a side wall of the member 14 and is covered by a housing portion 58. The slot is further defined by an underlying support ledge 57. When the stem glass having the small bowl is inserted into member 14, its flat base can be disposed on the support base 34 at the bottom of the member 14 and a portion of the flat base may be received in the slot 56 also resting on ledge 57. This stabilizes the stem glass in member 14. Additionally, it will be appreciated that the closed housing 58 segregates the compartments of the plate body 12 from the base of the stem glass, thereby preventing spillage or leakage of food from plate body 12 onto the glass.

Referring to FIGS. 7–9, wherein like reference numerals as in the prior embodiments are applied to like parts, followed by the suffix "a", the member 14*a* has a plurality of inwardly directed, circumferentially spaced flutes 60 formed adjacent the base of member 14*a*. Slots 62 are also formed below the flutes 60. Thus, upon pivoting the support base 34*a* downwardly from its second position illustrated in FIG. 7 to its first position lying generally parallel to the bottom 16*a* of plate body 12*a*, the support base 34*a* will deform the flutes 60 in a generally outward direction such that the circumferential margin of the base 34*a* is received in the slots 62. Thus, the base 34*a* is maintained and supported in a horizontal position adjacent the base of member 14*a*.

It will be appreciated that the materials of the combined food plate and beverage holder article according to the present invention may vary. For example, stiff cardboard-type material may be used. Alternatively, plastic materials may be utilized or combinations thereof, such as a thin coating of plastic material over a cellulosic product. Preferably, the article is formed integrally of the selected material.

In accordance with the present invention, it will be appreciated that each of the articles may be stacked relative to other articles. For example, in order to facilitate the transportation and storage prior to use of the combined food plate and beverage-container-holder article hereof, the member 14 of each article may be inserted into the larger diameter opening of corresponding member 14 of a superposed article whereby the articles may be nested or stacked one on top of the other. To facilitate this, the tabs 42 may be flexed or hinged upwardly to enable stacking or nesting with the conical member 14 inserted into an overlying member 14. When the plate is to be used, the tabs under the weight of the container will flex or hinge into a horizontal position to support the container.

In using the article of the present invention, it will be appreciated that the individual can simply grasp the member 14 which, in turn, will support the entirety of the plate from that one side. That is, with the use of reinforcing ribs 20 in the plate, or a plate having sufficient structural rigidity without ribs, and notwithstanding the weight of food placed on the plate, the article hereof can be readily held and manipulated by grasping about member 14 with one hand.

Figure 10:
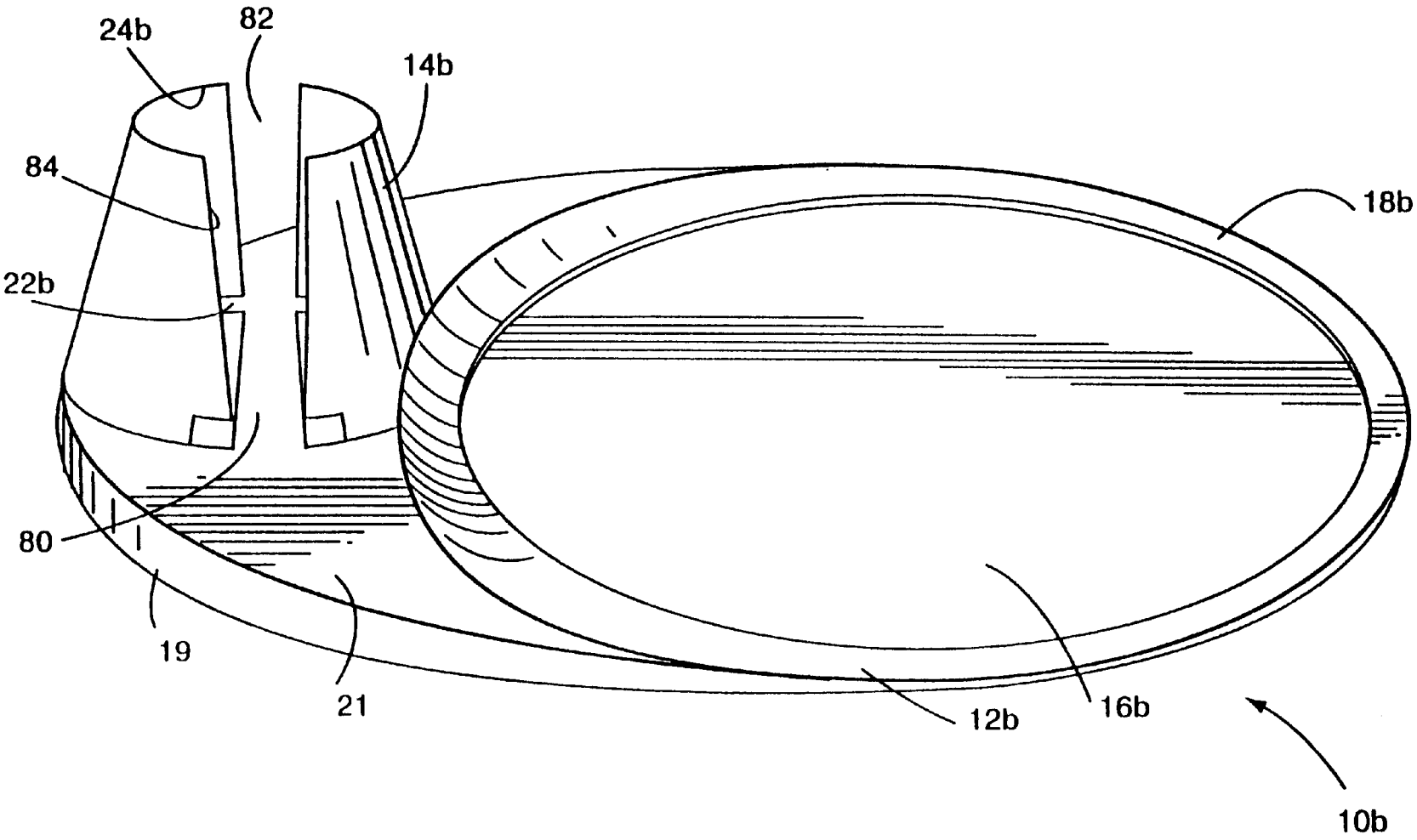
FIG. 10 is a perspective view of the combination food plate and beverage-container-holder article constructed in accordance with a further embodiment of the present invention.
Figure 11:
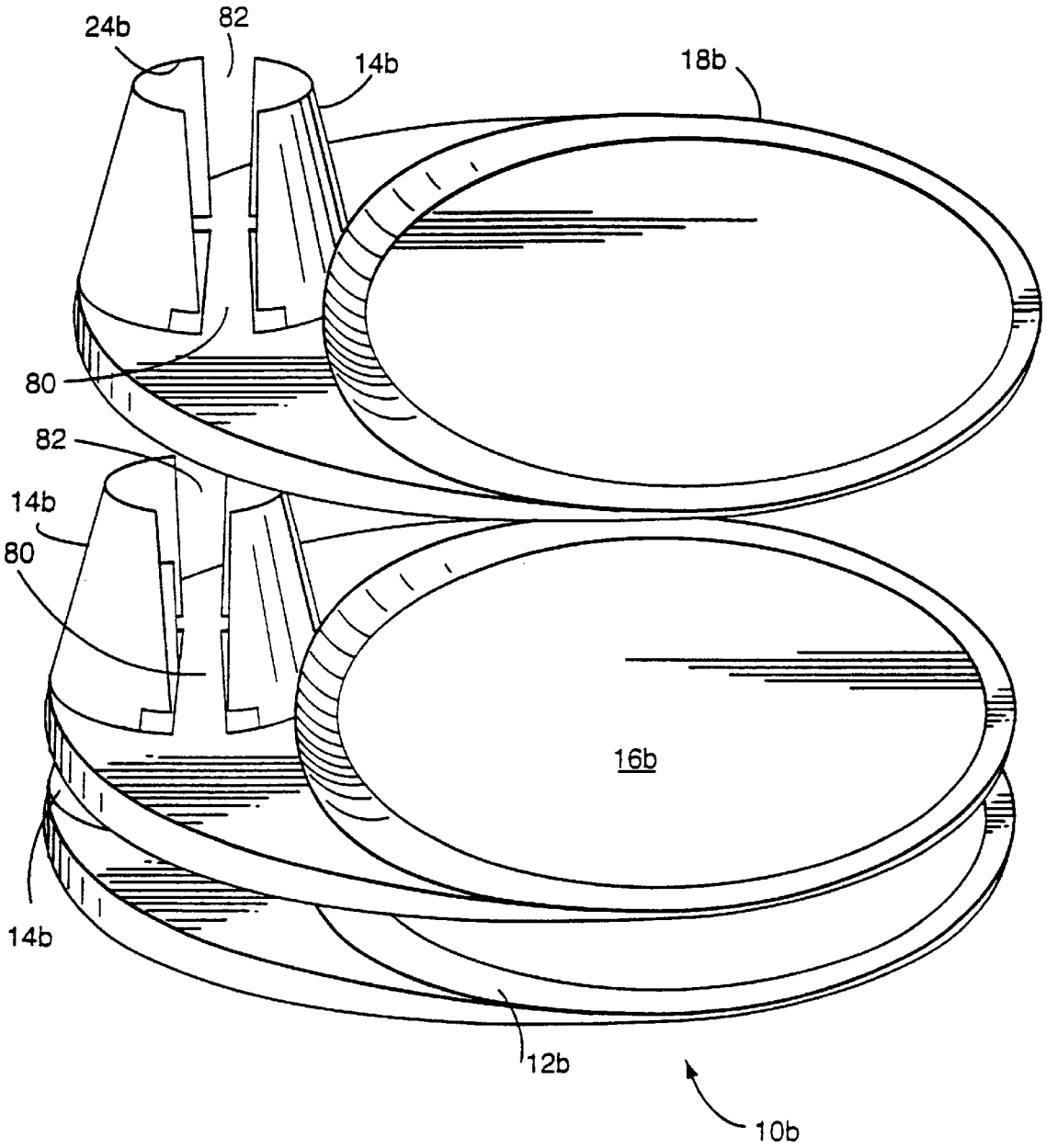
FIG. 11 is a perspective view of a plurality of articles of FIG. illustrating a nesting relationship among the various articles.

Referring to FIGS. 10 and 11 wherein like reference numerals as in the prior embodiments are applied to like parts, followed by the suffix "b," the article 10*b* has a plate body 12*b* which includes a generally flat or horizontal plate bottom 16*b* surrounded by an upstanding margin or lip 18*b*. The plate bottom 16*b* may be flat for receiving an overlying plate such as a disposable paper plate or may have ribs as in the prior embodiment illustrated in FIG. 1 defining different sections of the plate for containing different food items. In this form, however, the plate bottom 16*b* is offset from the central portion of the article 10*b* as illustrated. To one side of the plate body 12*b* and lying adjacent a downturned margin 19 of article 10*b* is a truncated conical beverage-container-holder member 14*b* having an opening 22*b* at its lower end larger in diameter than the opening 24*b* at its upper end. The article 10*b* includes a flat upper surface 21 interconnecting the upturned margin or lip 18*b* with the downturned margin 19, thus providing structural support for the plate and member, enabling an individual to carry the article by grasping the off-center member 24*b* with one hand, notwithstanding the weight of the food placed on the plate bottom 16*b* and the beverage and container placed within member 14*b*. The member 14*b* extends above the plate body 12*b* as in the prior embodiment, a distance preferably about four or five times the height of the plate body and sufficiently such that the four fingers of an individual's hand can grasp about the upstanding member 14*b*. Preferably, the member 14*b* extends upwardly above the upper surface of the article 10*b* a distance at least three inches such that the individual may grasp the member 14*b* with one hand and support the article together with the beverage container and food on the plate body 16*b* from the member 14*b*.

As in the prior embodiment, the upper reduced diameter opening 24*b* provides a support for a beverage container, for example, a cup or the bowl of a wine stem as previously discussed. Flutes may be formed in horizontal bands about member 14*b* to facilitate gripping the member 14 by the individual. Also, as in the prior embodiment, the article 10*b* is preferably formed integrally of a plastic material for disposable use or non-disposable re-use. Other materials may also be used such as cellulosic materials.

In the form of article illustrated in FIGS. 10 and 11, a support base is provided adjacent the lower opening 22*b* of member 14*b* for supporting a beverage container such as a cylindrical can which would otherwise be unsupported when received within the hollow interior of member 14*b*. The support base in this form may comprise a single integrally formed strip 80 formed as a continuation of the upper flat surface 21 of the plate. Alternatively, the strip 80 can be located at an elevation above or below the surface 21 provided only that it may support a beverage container disposed within member 14*b*. As illustrated, the support base 80 extends diametrically from one side of the member 14*b* to its opposite side, i.e., across the peripheral confines of member 14*b*. As a further alternative, the support base 80 could be in the form of a single chevron with its apex adjacent the center of the member 14*b* or two or more strips of material extending across the lower opening 22*b*, or an arcuate strip or strips extending across the through opening defined by member 14*b* between opposite open upper and lower ends 24*b* and 22*b* thereof, respectively. Consequently, in this configuration, a beverage container, for example, a can, may be disposed within the member 14*b* and supported by the support base 80, the upper end of the can projecting above the reduced diameter opening 24*b* of member 14*b*. Additionally, slots or apertures 85 may be provided in member 14*b* adjacent the junctures of a support base 80 and member 14*b*. Thus, as in the embodiment of FIG. 6, the base of a stem glass may be inserted into the slots for support by support base 80 and a portion of surface 21, the stem glass being disposed off-center relative to the member 14*b*.

It is a feature of this embodiment of the present invention that a plurality of articles 10*b* can be nested one within the other, notwithstanding the fixed nature of the support base 80 across the lower opening 22*b* of member 14*b*. To accomplish this, the member 14*b* has a pair of slots 82, extending upwardly from the support base 80 and opening through the reduced diameter upper end 24*b*. The edges 84 of the member 14*b* defining the slots 82 are tapered upwardly and away from one another. Thus, with the support base 80 extending diametrically across the lower opening 22*b*, the slots 82 are diametrically opposed to one another and in vertical registration with the support base 80. Where a chevron-shaped or arcuate support base 80 is employed, the slots 82 are located about the member 14*b* at locations in vertical registration with side portions of the support base. Also, it will be appreciated that the interior walls of the member 14*b*, similarly as in prior embodiments, taper toward one another in an upward direction about the through opening defined by member 14*b* thereby enabling nesting of the members one within the other.

To nest the articles 10*b* one within the other, the member 14*b* of one article, for example, the lower article in FIG. 11, is inserted into the interior of the member 14*b* of the upper article 10*b* with the slots of the lower nesting article 10*b* aligned with and receiving the support base or strip 80 of the upper member 14*b* whereby a plurality of the articles are stacked in nested relation one with the other. As noted above, the slots 82 and support base 80 do not necessarily lie along a diameter of the member but may lie at different circumferential locations thereabout. It is only necessary that the slots and support base vertically register with one another so as to permit nesting. It will be appreciated that the taper of the slots facilitates entry of the overlying support base 80 into the slots 82 when nesting the articles. To remove an article from the stacked or nested articles, the uppermost or lowermost article is simply displaced away from the adjoining article thereby withdrawing support base and slots relative to one another. Note also that the engagement of the support base in the slots locks the articles against slipping or sliding laterally relative to one another thereby maintaining the articles nested in proper alignment with one another.

A single slot in member 14*b* may be used where the support base 80 does not extend between opposite sides of the member 14*b*, e.g., when the support base extends only part-way into the peripheral confines of member 14*c*. Thus, a single support base may extend from the plate body or member 14*b* into the peripheral confines of member 14*c* to form a horizontal stop or support for a beverage container received within member 14*b*. Preferably, the single support base extends at least to the axis of the vertical opening through member 14*b* and may have a fluted or corrugated configuration to render the base 80 rigid. It will be appreciated that a single slot in vertical registration with the support base 80 along the side of member 14*b* or the plate body from which it projects is sufficient to enable nesting of multiple articles similarly as previously described.

Figure 12:
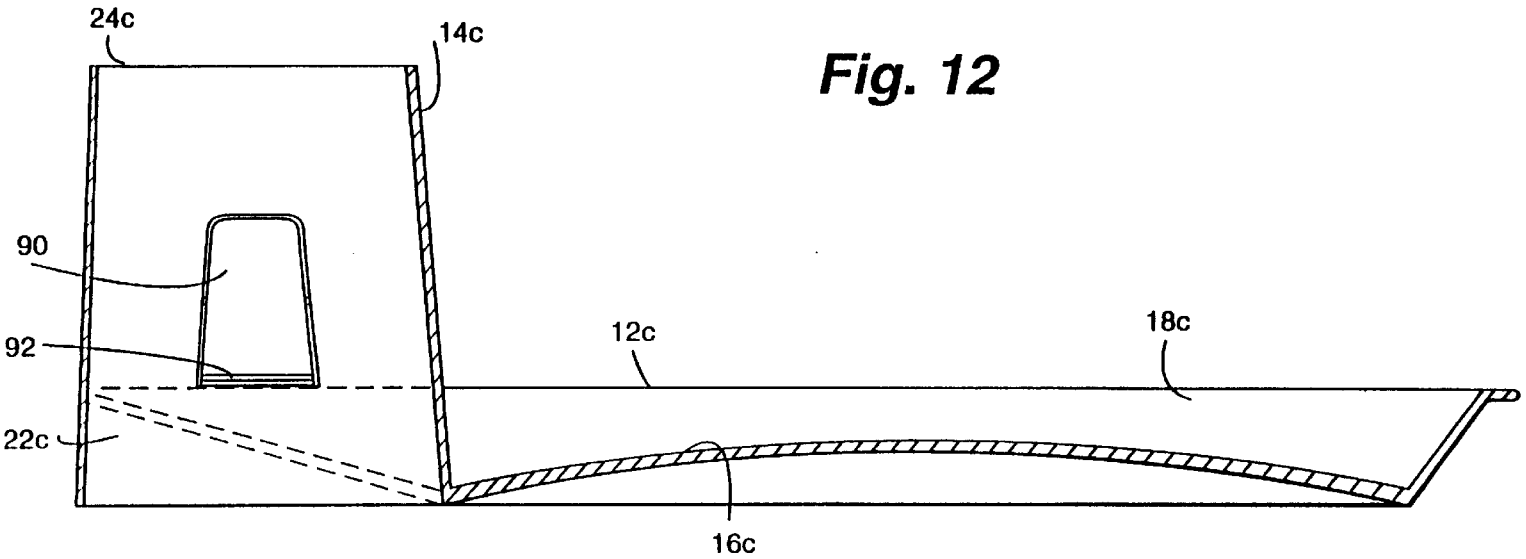
FIG. 12 is a cross-sectional view of a further embodiment of an article according to the present invention.
Figure 13:
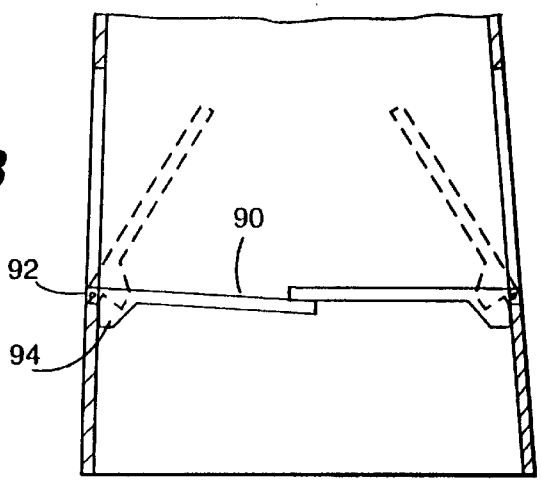
FIG. 13 is a fragmentary cross-sectional view thereof illustrating the support base in position for supporting a beverage container.
Figure 14:
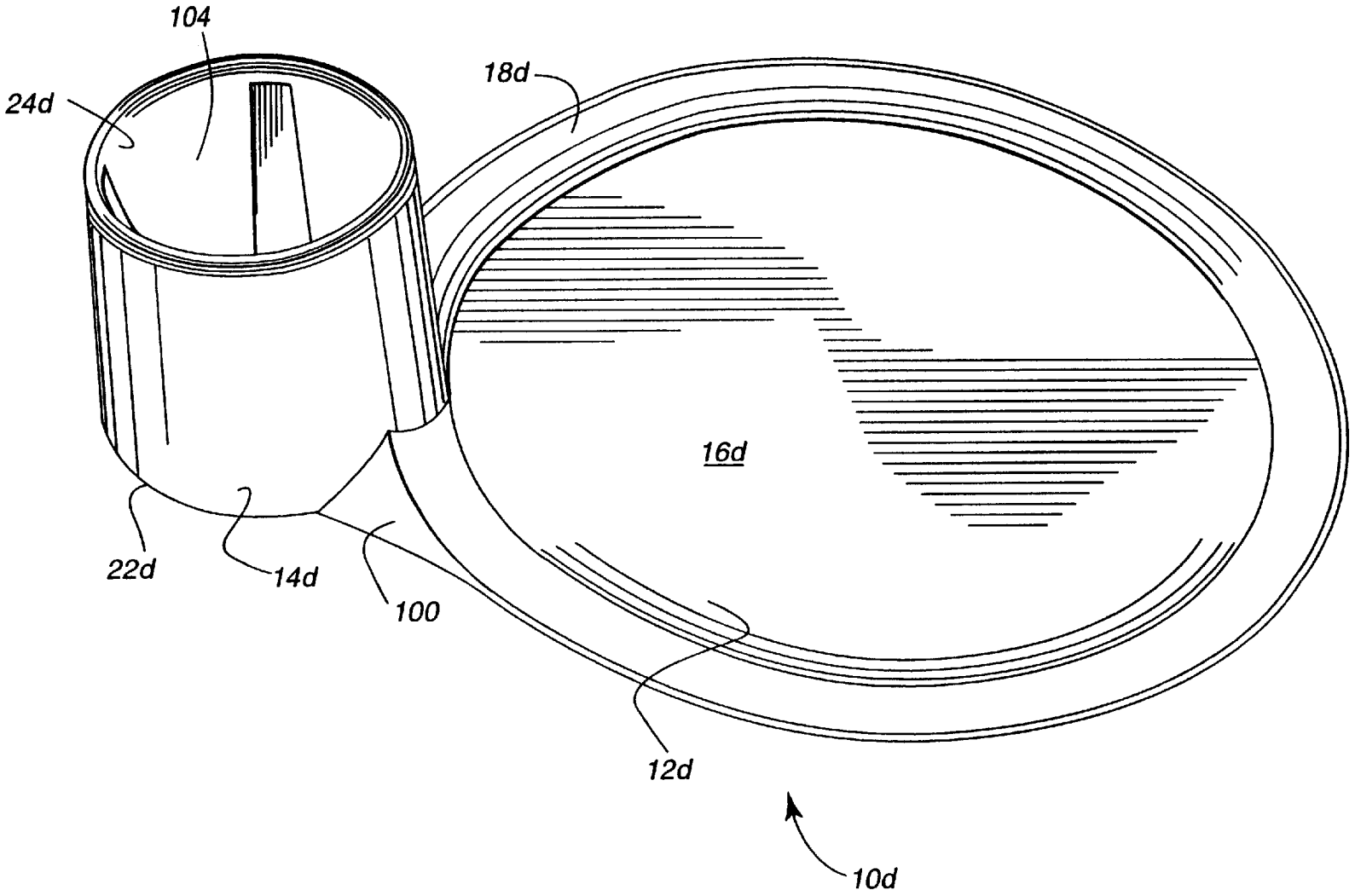
FIG. 14 is a perspective view of a combination food plate and beverage-container-holder article according to a further embodiment of the present invention.
Figure 17:
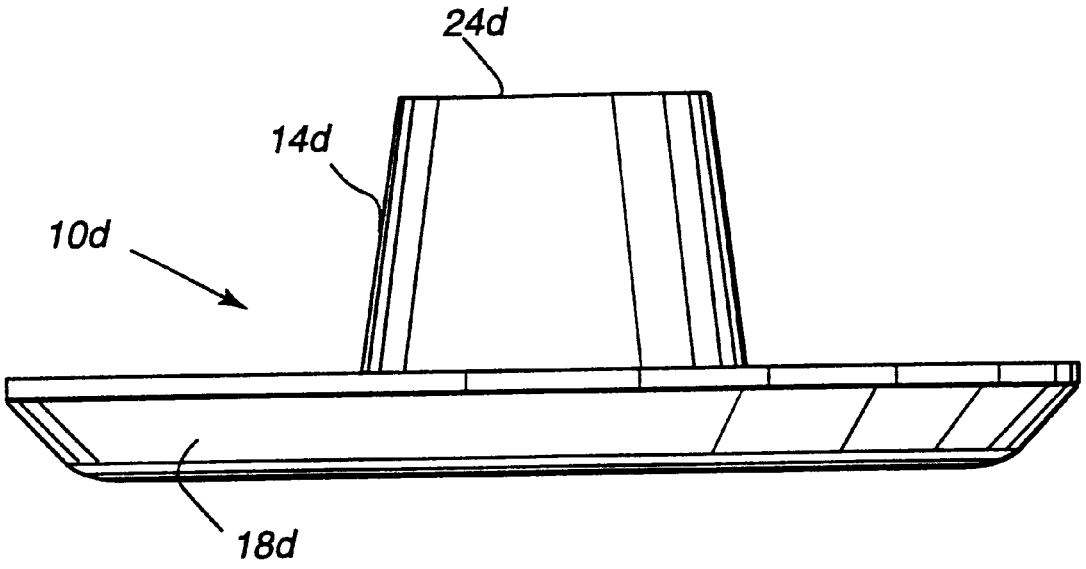
FIG. 17 is an end elevational view thereof.
Figure 18:
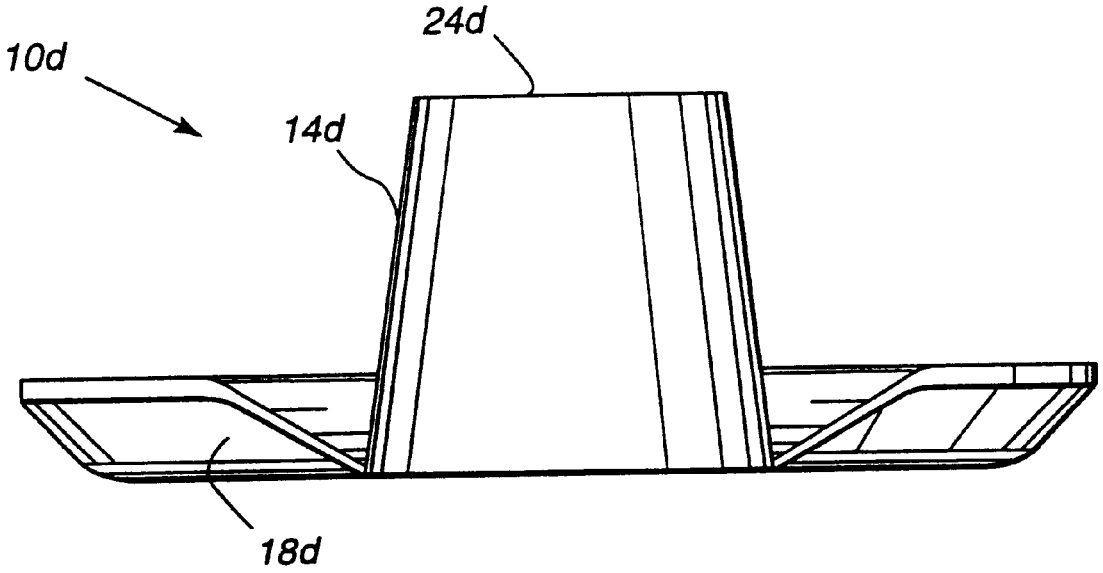
FIG. 18 is a view similar to FIG. 17 taken from the opposite end.

Referring now to a further embodiment of the invention, there is illustrated in FIGS. 12 and 13 an article 10*c* having a plate body 12*c* with a margin 18*c* about the plate body, the plate body having a slight dome-shaped bottom surface 16*c*. As in the prior embodiments, a frustoconical beverage container member 14*c* projects upwardly from the article at an off-center location near the margin of the article and has open upper and lower ends 24*c* and 22*c*, respectively, the lower end being larger in diameter than the upper end. In this form, at least one tab 90 forming a portion of the wall of member 14*c* is pivotal between a position conforming to the contours of the wall of member 14*c* as illustrated in FIG. 12 and a position forming a horizontal support for a container received within member 14*c*. Preferably, the flap 90 has an integral hinge 92 with the wall of member 14*c*.

As illustrated in FIG. 13, an interior portion of the flap 90 adjacent the hinge 92 forms a stop 94. Thus, when the flap 90 is depressed inwardly to pivot about hinge 92 into a generally horizontal position, the stop 94 engages the interior side wall of member 14*c*, providing a stop for flap 90 whereby flap 90 may serve as a horizontal support for a beverage container disposed in member 14*c*. As illustrated in FIG. 13, a pair of flaps 90 are provided which may or may not overlap relative to one another. It will be appreciated that the flaps, when forming a continuation of the wall portions of member 14*c*, permit the article 10*c* to be nested in relation to other articles 10*c*, similarly as previously described.

In a further preferred embodiment of the present invention illustrated in FIGS. 14–21, there is illustrated a combination food plate and beverage-container-holder article, generally designated 10*d*, comprised of a plate body 12*d* and a frustoconical beverage-container-holder member 14*d*. The plate body 12*d* is similar to the plate body in the second embodiment hereof and includes a generally horizontal plate bottom 16*d* having an upstanding circumferentially extending lip 18*d*. The plate body 12*d* may or may not have a plurality of upstanding ribs for dividing the plate into various compartments.

Figure 19:
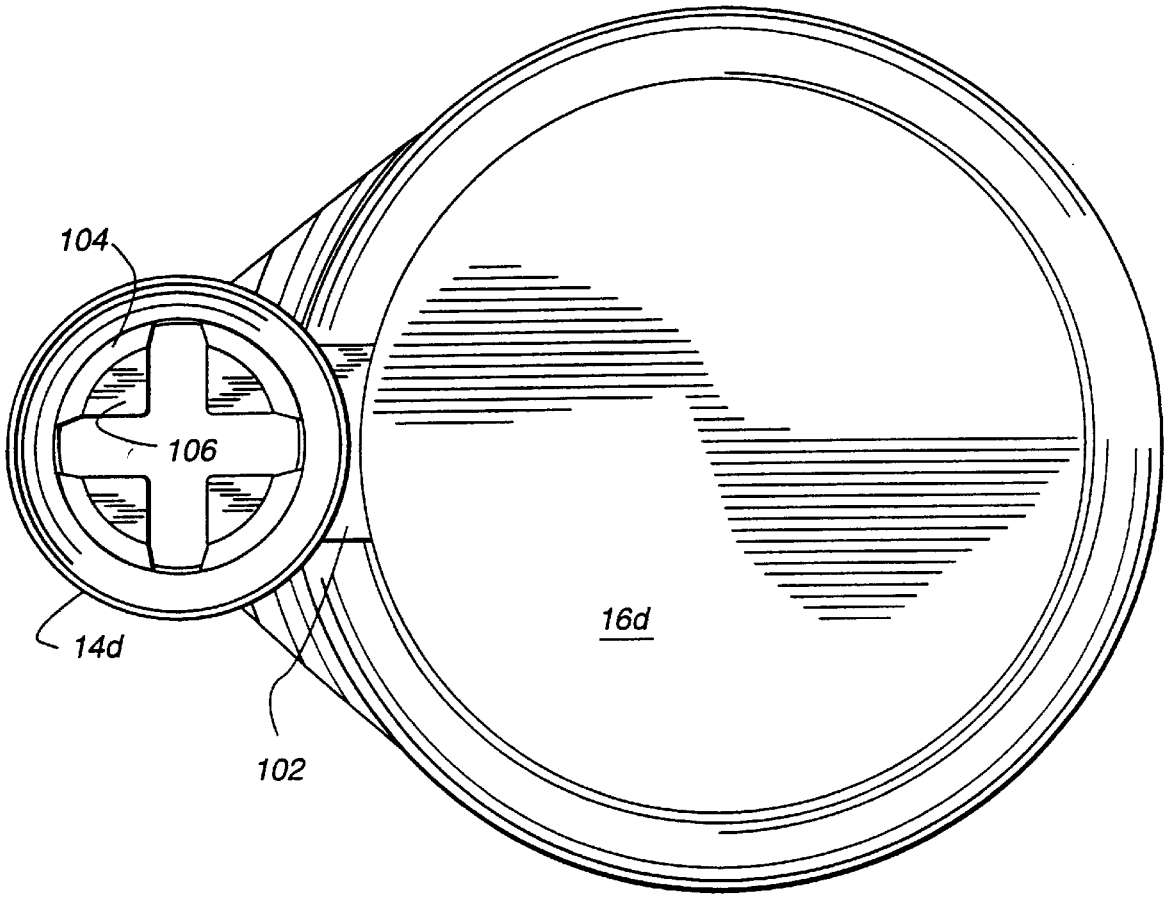
FIG. 19 is a bottom plan view thereof.
Figure 20:
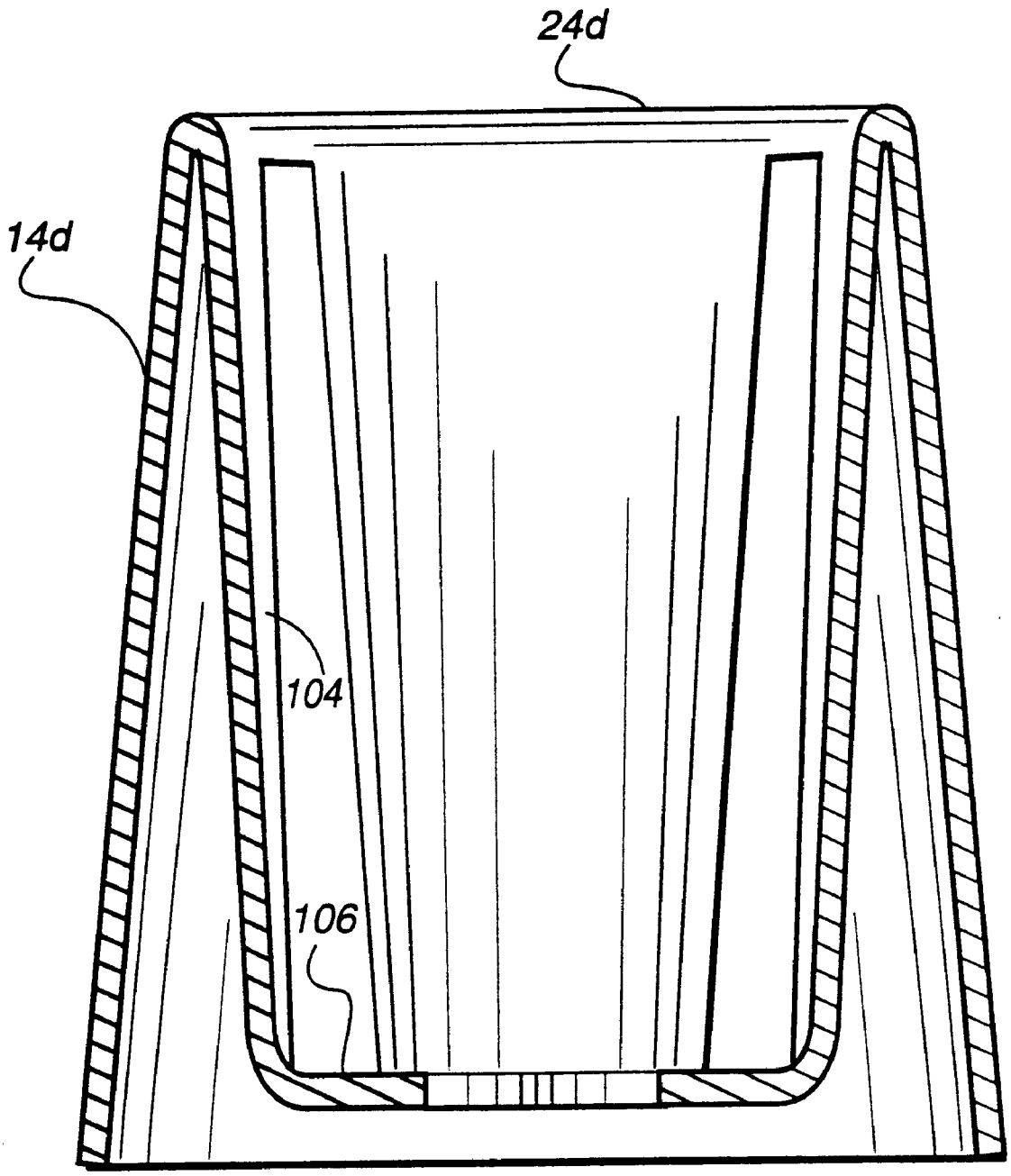
FIG. 20 is a cross-sectional view thereof taken about on line 20—20 in FIG. 15.

As illustrated, the member 14*d* lies off-center of the plate and, in this form, generally substantially outside of the peripheral confines of the plate body 12*d*. Only a small wall portion of the member 14*d* lies within the circumferential extent of the lip 18*d*. The member 14*d* is essentially cantilevered from the plate body 12*d* and reinforcing ribs 100 extend between the lip 18*d* of the plate body 12*d* to the wall of the member 14*d*. Additionally, as illustrated in FIG. 19, a reinforcing rib 102 extends as a continuation of the planar surface of the plate body 16*d* for securement to the wall of member 14*d*. It will be appreciated that the member and plate body are integrally formed one with the other, preferably of a plastic material.

In the embodiment hereof illustrated in FIGS. 14–20, and as in the previous embodiments, the member 14*d* is configured with a through opening with an opening 22*d* at its lower end larger in diameter than the diameter of the opening 24*d* at its upper end. The member 14*d* thus has a reduced diameter upper opening 24*d*, an enlarged diameter opening 22*d* at its lower end and a through opening between the opposite ends of the member 14*d*. Additionally, the member 14*d* is configured and sized such that an individual may be able to grasp the member 14*d* with the full five fingers on one hand to support the plate body 12*d* and member 14*d* with food and/or beverage products carried by the article simultaneously with the one hand.

In this form of the present invention, however, support elements 104 are provided about the interior wall surface of member 14*d*. The support elements 104 are preferably integrally formed with the member 14*d* and depend from adjacent the upper end of member 14*d*, i.e., adjacent the smaller diameter opening 24*d*, and terminate at a lower end within member 14*d*. In the illustrated form, four support elements 104 are arranged in each quadrant with a space between the elements. The lower ends of the elements 104 terminate in generally horizontally extending flanges 106. It will be appreciated that the elements 104 are inclined inwardly toward one another, i.e., toward the central axis of the member 14*d* from adjacent the upper end of member 14*d* toward its lower end. The support elements 104 are also flexible in a generally radial direction to accommodate different-sized beverage containers. The flanges 106, of course, are provided to engage the bottom of and thereby support the beverage container. It will also be appreciated that the support elements 104 are spaced progressively from the interior wall surface of the member 14*d* from adjacent the upper end of member 14*d* to the lower end. The flanges 106 terminate at a location preferably lying at an elevation between the upper and lower edges of the lip 18*d* of the plate body 12*d*.

With the support elements 104 inclined inwardly from top to bottom, it will be appreciated that articles constructed in accordance with this embodiment can be nested one within the other similarly as illustrated in FIG. 11. Thus, when the articles are nested, the underlying member 14*d* resides within the interior of the overlying member 14*d* and between the interior wall surfaces of member 14*d* and the exterior wall surfaces of the support elements 104. Thus, the article of FIGS. 14–19 may be nested and stacked in a space-saving manner.

Referring now to FIGS. 21–23, there is illustrated a further configuration of the member 14*e*. It will be appreciated that the illustrations of FIGS. 21–23 are illustrations of the members 14 only and that the plate body is integrally formed with these members as in the prior embodiments. Referring to FIGS. 21–23, the member 14*e* has a depending support element 104*e* which is inclined from adjacent the top of member 14*e* toward its bottom and also toward the central axis of member 14*e* similarly as support elements 104 are inclined in the prior embodiment. However, instead of terminating in a flange similar to flange 106, the support element 104*e* has a horizontal support flange 108 which extends from the lower end of support element 104*e* to the opposite side wall of member 14*e*. As illustrated in FIG. 22, the horizontal support flange 108 is formed integrally with the member 14*e* and has an enlarged central portion 109. Consequently, both the top and bottom of the member 14*e* remain open to facilitate nesting of the articles, as described below.

Additionally, the member 14*e* also includes a slot 110 through a side wall thereof. The slot 110 opens through the upper end 24*e* of member 14*e* and is closed at its lower end. The edges 111 defining the slot 110 taper toward one another from the upper end 24*e* toward the lower end of member 14*e*. Preferably, the slot is located opposite the support element 104*e* and terminates at its lower end at the juncture of the horizontal flange 108 with the wall of member 14*e*. Consequently, the horizontal flange 108 is fully supported along its opposite end edges by the wall of member 14*e* and support element 104*e*. The slot is for purposes of receiving the handle of a beverage container, for example, a coffee cup. The bottom of the cup can therefore rest on the horizontal flange 108 with its handle projecting through the slot 110. The orientation of the slot relative to the plate body is preferably on the side of member 14*e* facing the plate body 16*e*.

With the configuration of the members 14*e* forming part of the articles, it will be appreciated that the articles can be nested. Thus, the underlying article may be nested with an overlying article by inserting the underlying member 14*e* into the overlying member 14*e* of the other article with the wall portions of the underlying article disposed between the interior wall surface and the support element 104*e* of the overlying article. It will be appreciated that the slot 110 of the underlying article receives a portion of the horizontal flange 108 of the overlying article, thus permitting a close-nesting relationship of the adjacent articles for space-saving storage purposes.

Figure 24:
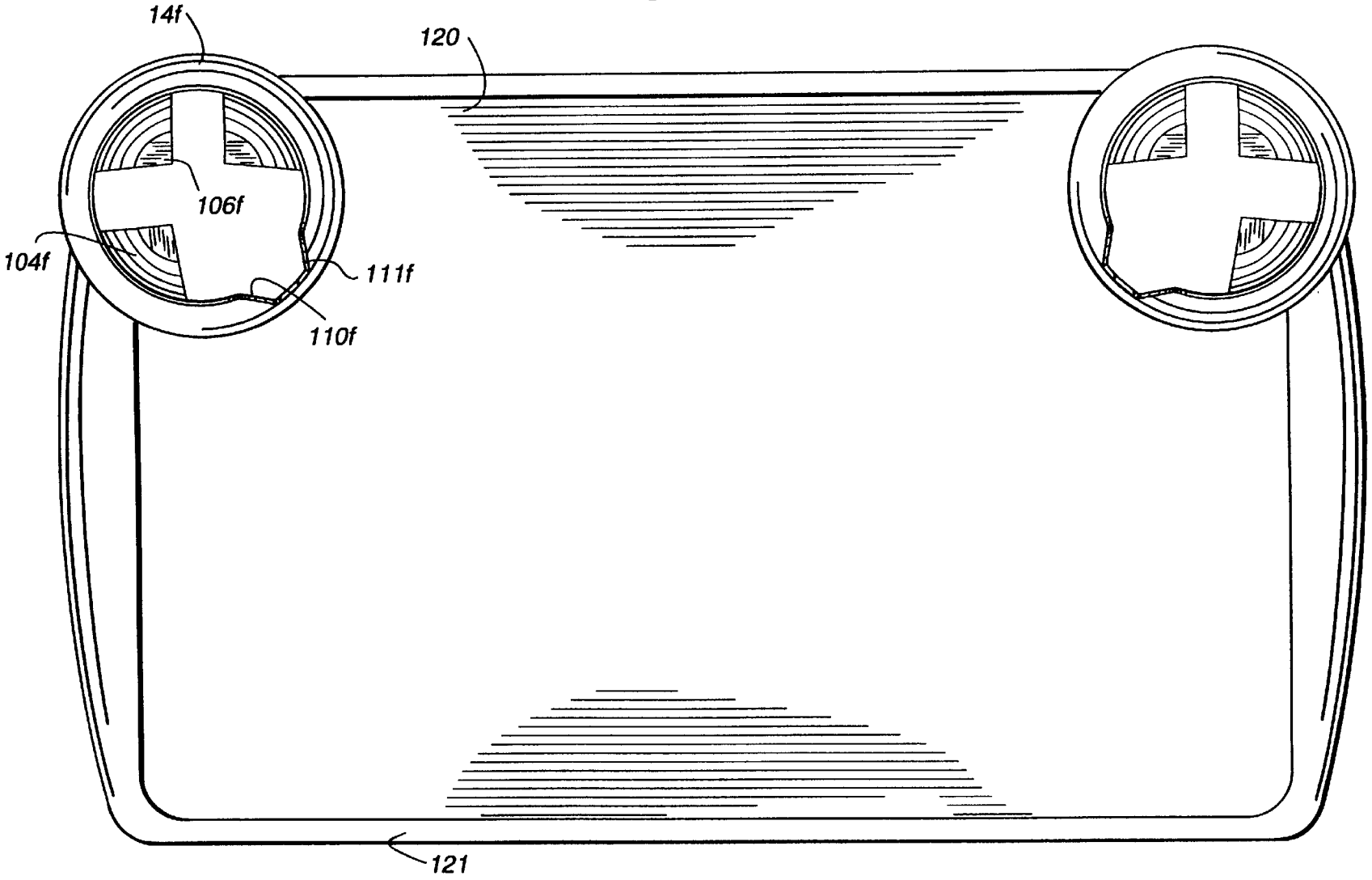
FIG. 24 is a top plan view of a further embodiment of the article according to the present invention.

Referring now to the embodiment hereof illustrated in FIG. 24, the article may comprise either a plate or a tray 120 which may typically be used to carry food and beverage containers for one or more individuals. In the form hereof illustrated in FIG. 24, the plate or tray is illustrated in a generally rectilinear configuration having an upstanding lip 121 about its margin. A pair of members 14*f* may be disposed at each of a pair of the corners of the tray. Thus, each of members 14*f* may be integrally formed with the tray. As illustrated, the members 14*f* may have support elements 104*f* similar to the support elements 104*d* of the embodiment hereof illustrated in FIGS. 14–19. In this form, however, one of the support elements is omitted and a slot 110*f* is formed in lieu of the support element. Alternately, the slot 110*f* may be formed between the support elements 104*f* with two or more of the support elements 104*f* arranged symmetrically about the axis of member 14*f*. The slot as in the prior embodiment of FIGS. 21–23, is open at the top of the member 14*f* and closed at its bottom, the side edges 111*f* tapering from top to bottom toward one another. The illustrated support elements 104*f* terminate at the lower distal ends in horizontal projecting flanges 106*f* serving as supports for a beverage container disposed in member 14*f*. It will be appreciated that large plastic containers oftentimes have handles projecting laterally from the containers. Thus, the members 14*f* can accommodate such large containers with the handles being received in the slots 110*f*.

Similarly as in the prior embodiments, the members 14*f* and support elements 104*f* are configured such that articles of that configuration can be nested one with the other. It will be appreciated that by inserting a pair of underlying members 14*f* into the lower openings of an overlying article, the wall and support elements of the underlying members 14*f* may be received between the interior wall surfaces and support elements of the overlying article, enabling a close nesting relationship between adjacent articles.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combination food plate and beverage-container-holder article comprising:

a plate body for supporting food and having a generally upstanding lip substantially about the margin of the body; and a beverage-container-holder formed integrally with and upstanding relative to said body, said holder including a generally truncated cone-shaped member having an open upper end spaced above said plate body whereby a beverage container is at least in part receivable within said member through said open upper end thereof and a lower wall portion adjacent said plate body larger in diameter than a diameter of said open upper end;

said member being located off-center relative to said plate body and adjacent a margin thereof, said member having at least one beverage container support element carried thereby within said member below the upper end thereof for supporting the beverage container within the holder.

2. An article according to claim 1 wherein said one element depends from said member from a first location within said member to a second location lower than said first location.

3. An article according to claim 1 wherein said one element is flexible in a generally radial direction and depends from said member adjacent said upper end thereof to extend along the inside of said member, said element terminating in a free lower end thereof having an inwardly projecting flange for supporting the beverage container.

4. An article according to claim 1 wherein said member includes a second beverage container support element within said member below the upper end thereof, each of said elements being flexible in a generally radial direction and depending from said member adjacent said upper end thereof to extend along the inside of said member, said elements terminating in a free lower end thereof having an inwardly projecting flange for supporting the beverage container, said flanges being spaced from one another.

5. An article according to claim 4 wherein said elements lie along diametrically opposite sides of said member and are inclined toward one another in a direction from said upper end toward said lower wall portion.

6. An article according to claim 1 including a slot through said member opening through said upper end thereof and being closed at a lower end thereof for receiving a laterally projecting handle of a beverage container.

7. An article according to claim 1 wherein said one element depends from said member adjacent said upper end thereof to extend along the inside of said member and terminates in a support base extending across said member for securement to a wall of said member opposite said depending element for supporting a beverage container.

8. An article according to claim 7 including a slot through said member opening through said upper end thereof and being closed at a lower end thereof for receiving a laterally projecting handle of a beverage container, said slot having a lateral extent between opposite side edges thereof throughout the majority of the length of the slot greater than the lateral extent of said base support at predetermined locations therealong.

9. An article according to claim 7 wherein said base support has a laterally enlarged central portion and reduced portions straddling said central portion and connected to said element and a wall member of said member, respectively.

10. An article according to claim 1 including a second member spaced from said first member and located off-center relative to said plate body and adjacent a margin thereof, said second member having at least one beverage container support element within said second member below the upper end thereof for supporting a beverage container within the second member.

11. An article according to claim 10 wherein said elements depend said members from a first location within said members, respectively, to a second location lower than said first location.

12. An article according to claim 10 wherein said elements are flexible in generally radial directions and depend from said member adjacent said upper ends of the respective members to extend along the insides thereof terminating in free lower ends thereof having inwardly projecting flanges for supporting the beverage containers.

13. An article according to claim 10 wherein each of said members includes a slot opening through said upper end thereof and being closed at a lower end thereof for receiving a laterally projecting handle of a beverage container.

14. An article according to claim 10 wherein said plate has a generally rectangular configuration, said members being located adjacent a pair of corners of said body along a common side thereof.

15. An article according to claim 14 wherein each of said members includes a slot opening through said upper end thereof and being closed at a lower end thereof for receiving a laterally projecting handle of a beverage container, said slots being located on sides of said member facing said plate body.

16. A combination food plate and beverage-container-holder article comprising:

a plate body for supporting food and having a generally upstanding lip substantially about the margin of the body;

a beverage-container-holder formed integrally with and upstanding relative to said body, said holder including a generally truncated cone-shaped member having an open upper end spaced above said plate body for receiving at least in part a beverage container within said member through said open upper end thereof and a lower end of said member defining an opening larger in diameter than a diameter of said open upper end of said member;

a support carried by said article depending from a first location within said member to a second location within said member lower than said first location, said support lying within peripheral confines of said member to at least partially close said lower open end of said member for supporting the beverage container in said beverage-container-holder;

said member being located off-center relative to said plate body and adjacent a margin thereof, said member extending upwardly above said lip a distance sufficient such that at least a portion of said member extending upwardly above said lip can be grasped by an individual's fingers above the plate body to enable the plate with food thereon and a beverage container in the beverage-container-holder to be carried by one hand.

17. An article according to claim 16 wherein said member includes a second beverage container support element within said member below the upper end thereof, each of said elements being flexible in generally radial directions and depending from said member adjacent said upper end thereof to extend along the inside of said member, said elements terminating in a free lower end thereof having an inwardly projecting flange for supporting the beverage container, said flanges being spaced from one another.

18. An article according to claim 16 including a slot through said member opening through said upper end thereof and being closed at a lower end thereof for receiving a laterally projecting handle of a beverage container.

19. Nestable combination food plate and beverage-container-holder articles comprising:

a plurality of plate bodies for supporting food thereon, each said plate body having a generally upstanding lip substantially about a margin of said body and a beverage-container-holder formed integrally with and upstanding from said body;

each of said beverage-container-holders including a generally truncated cone-shaped member having an open upper end spaced above said plate body for receiving at least in part a beverage container within said member through said open upper end thereof and a lower wall portion adjacent said plate body defining an open lower end larger in diameter than a diameter of said open upper end of said member;

each said member being located off-center relative to said body and adjacent a margin thereof;

a support element carried by each said member depending from a first location within said member to a second location within said member lower than said first location and spaced from a wall of said member for supporting the beverage container in said beverage-container-holder; and said plate bodies being nestable relative to one another with each underlying member being in part receivable within an overlying member of an adjacent article through said open lower end of the overlying member and in part located between said support element and said member wall of the overlying member, said support element of said overlying member lying at least in part within the peripheral confines of said underlying member.

20. An article according to claim 19 wherein each said plate body includes a second member spaced from said first member and located off-center relative to said plate body and adjacent a margin thereof, said second member having at least one beverage container support element within said second member below the upper end thereof for supporting a beverage container within the second member, said plate bodies being nestable relative to one another with each underlying member being in part receivable within an overlying member of an adjacent article through said open lower end of the overlying member and in part located between said support element and said member wall of the overlying member, said support elements of said overlying member lying at least in part within the peripheral confines of said underlying member, respectively.

* * * * *